US010422486B2

(12) United States Patent
Zhang

(10) Patent No.: US 10,422,486 B2
(45) Date of Patent: Sep. 24, 2019

(54) LIGHTING DEVICE AND LAMP STRING

(71) Applicant: ZHEJIANG BESTIME TRADING CO., LTD., Zhejiang (CN)

(72) Inventor: Gaole Zhang, Zhejiang (CN)

(73) Assignee: HANGZHOU BINARY OPTOELECTRONICS & TECH., LTD., Zhejinag (CN)

( * ) Notice: Subject to any disclaimer, the term of this patent is extended or adjusted under 35 U.S.C. 154(b) by 0 days.

(21) Appl. No.: 15/828,954

(22) Filed: Dec. 1, 2017

(65) Prior Publication Data

US 2018/0372278 A1 Dec. 27, 2018

(30) Foreign Application Priority Data

Jun. 22, 2017 (CN) ..... 2017 1 0478902
Oct. 13, 2017 (CN) ..... 2017 1 0949628

(51) Int. Cl.

| | |
|---|---|
| ***F21V 21/00*** | (2006.01) |
| ***F21S 4/00*** | (2016.01) |
| ***F21K 9/237*** | (2016.01) |
| ***F21V 17/06*** | (2006.01) |
| ***F21V 17/12*** | (2006.01) |

(Continued)

(52) U.S. Cl.

CPC ..... *F21K 9/237* (2016.08); *F21K 9/232* (2016.08); *F21K 9/235* (2016.08); *F21S 4/10* (2016.01); *F21S 4/26* (2016.01); *F21V 3/062* (2018.02); *F21V 17/002* (2013.01); *F21V 17/06* (2013.01); *F21V 17/12* (2013.01); *F21V 23/06* (2013.01); *F21V 31/005* (2013.01); *F21K 9/90* (2013.01); *F21Y 2115/10* (2016.08)

(58) Field of Classification Search

CPC ... F21K 9/00; F21K 9/20; F21V 9/083; F21V 2113/13; F21V 2113/17
USPC ..... 362/249.01, 249.02, 249.1, 249.11
See application file for complete search history.

(56) References Cited

U.S. PATENT DOCUMENTS

2007/0183153 A1 8/2007 Yu
2009/0256482 A1 10/2009 Powell
(Continued)

FOREIGN PATENT DOCUMENTS

CN 200968517 Y 10/2007
CN 201589206 U 9/2010
(Continued)

*Primary Examiner* — Daniel St Cyr
(74) *Attorney, Agent, or Firm* — Ballard Spahr LLP

(57) ABSTRACT

A lighting device comprises a lamp housing, a lighting body provided in the lamp housing and having a working voltage of direct-current 3V-36V, and a lamp base detachably connected with the lamp housing and in detachable electrical connection the lighting body. The lamp housing and the lamp base are made from a plastic material. A lamp string comprises a lamp wire and lighting devices electrically connected thereto. The lighting device and the lamp string are more convenient to assemble, do not require vacuum or filling of an inert gas. The lighting body, when damaged, can be disassembled and replaced at any time, with low production, maintenance and using costs. Using the plastic lamp base and lamp housing makes the lighting device more durable. No adapter is provided inside the lighting device, so that the internal structure of the lighting device is more simplified, and it is safer to use.

16 Claims, 6 Drawing Sheets

(51) Int. Cl.

| | |
|---|---|
| ***F21V 23/06*** | (2006.01) |
| ***F21S 4/10*** | (2016.01) |
| ***F21K 9/235*** | (2016.01) |
| ***F21V 3/06*** | (2018.01) |
| ***F21V 31/00*** | (2006.01) |
| ***F21S 4/26*** | (2016.01) |
| ***F21K 9/232*** | (2016.01) |
| ***F21V 17/00*** | (2006.01) |
| *F21K 9/90* | (2016.01) |
| *F21Y 115/10* | (2016.01) |

(56) References Cited

U.S. PATENT DOCUMENTS

| | | | | |
|---|---|---|---|---|
| 2013/0141892 | A1* | 6/2013 | Okazaki | F21V 3/00 362/84 |
| 2014/0265905 | A1* | 9/2014 | Ray | F21S 9/02 315/210 |
| 2014/0347852 | A1* | 11/2014 | Feit | F21K 9/23 362/235 |
| 2017/0202061 | A1* | 7/2017 | Allen | F21S 4/10 |

FOREIGN PATENT DOCUMENTS

| | | | |
|---|---|---|---|
| CN | 202118650 | U | 1/2012 |
| CN | 204285060 | U | 4/2015 |
| CN | 204459883 | U | 7/2015 |
| EP | 2267357 | | 12/2010 |

* cited by examiner

LIGHTING DEVICE AND LAMP STRING

This application claims priority to Chinese Patent Application No. 201710478902.X, filed on Jun. 22, 2017 with the State Intellectual Property Office (SIPO) of China and Chinese Patent Application No. 201710949628.X, filed on Oct. 13, 2017 with the State Intellectual Property Office (SIPO) of China, the contents of which are herein incorporated by reference in their entirety.

TECHNICAL FIELD

The present application relates to the field of decoration/lighting, and particularly to a lighting device and a lamp string.

BACKGROUND ART

In daily life lighting/decoration, lighting devices are widely used. The lighting device is a type of lamp which is powered up to heat filament (generally tungsten filament in modern times) by means of a resistor to be incandescent for lighting.

The existing lighting devices are usually encapsulated glass lighting devices of various types such as E14, E27, C7, C9, and the like, and need to be equipped with a corresponding lamp holder, resulting in a relatively high cost. Moreover, since a lighting body is encapsulated in a lamp housing, when the lighting body is damaged, the whole lighting device has to be discarded, increasing the maintenance and using costs.

Disclosure of the Invention

In view of this, an object of the present application is to provide a lighting device and a lamp string, applied to various application fields and having a high service lifetime and low production and maintenance costs, to overcome shortcomings in the prior art.

The present application provides: a lighting device, including a lamp housing, a lighting body and a lamp base, wherein the lamp housing is detachably connected with the lamp base, and the lighting body is in detachable electrical connection with the lamp base. A working voltage of the lighting body is 3V-36V, and the lamp base and the lamp housing are made from a plastic material. The whole lighting device has the characteristics of light weight, high strength, low fragility, less heating, and so on.

The lighting body is electrically connected with the lamp base through a female connector and a male connector, for example, the lighting body is provided with a male connector, and the lamp base is provided with a female connector, so that electrical connection or separation is realized between the lighting body and the lamp base through insertion. The lighting body is embodied as an LED filament. The LED filament includes two types, wherein one is an LED filament provided internally with a flexible circuit and having a positive terminal and a negative terminal stretching out from the same end, where such type of LED filament has a male connector directly, so the LED filament may be directly inserted into the female connector of the lamp base; the other is an LED filament having a positive terminal and a negative terminal stretching out from two ends of the LED filament respectively, so a lamp bracket is additionally provided to make the positive and negative electrodes of the LED filament come out from one side of the bracket, with the male connector provided on the bracket, then the LED filament is inserted into the female connector of the lamp base through the bracket.

The lamp base is provided with an installation hole. The installation hole is a through hole of the lamp base. The female connector is inserted into the installation hole so as to be fixed on the lamp base. In order to ensure the waterproofness of the lighting device, the lighting device further includes a lamp cover, and the lamp cover is covered at an end of the lamp base for blocking one end of the installation hole. Meanwhile, the lamp base or the lamp cover is further provided with a threading hole used for wiring.

The lighting device further includes a lampshade, and the lampshade is covered over the lamp base, with the lamp based entirely covered by the lampshade. The lamp housing and the lamp base are connected through threads.

As further extension of the above solutions, the present application further provides a lamp string, including a lamp wire and at least two lighting device mentioned above. The lighting devices are electrically connected on the lamp wire so as to form the lamp string. Two ends of the lamp wire are respectively provided with a male connector and a female connector which are matched with each other, so that a plurality of lamp strings can be connected in series to form a longer lamp string.

The technical solutions of the present application have the following advantages: in the lighting device and the lamp string of the present application, the lamp base is detachably connected with the lamp housing, and the lighting body is in detachable electrical connection with the lamp base. The power supply line of the lighting body directly comes out from the lamp base, and the lighting body and the lamp housing are directly connected to the lamp base, omitting a power supply adapter. Moreover, according its detachable property, when the lighting body is damaged, the lighting body can be replaced separately, rather than replacing the whole lighting device, with simple operation and use safety, greatly reducing the production, maintenance and using costs. Meanwhile, use of the plastic lamp base and lamp housing makes the lighting device have the properties of light weight, high strength, low fragility, and durability and able to be used in various application circumstances, at the same time, the low voltage LED lighting body using direct-current 3-36V has a low cost and high using safety. The lighting device/the lamp string of the present application, which has a simple structure and a small heating amount and is convenient to install and disassemble, is a lighting device/lamp string capable of being applied to various circumstances, having a long service lifetime, and low production, using and maintenance costs. In order to make the above objects, features, and advantages of the present application clearer and easier to understand, preferred examples are illustrated below to make the following detailed description in combination with the accompanying drawings.

BRIEF DESCRIPTION OF DRAWINGS

In order to more clearly illustrate technical solutions of examples of the present application, figures which are needed for description of the examples will be introduced briefly below. It should be understood that the figures below merely show some examples of the present application, and therefore should not be considered as limiting the scope. A person ordinarily skilled in the art still can obtain other relevant figures according to these figures, without using inventive efforts.

Figure 1:
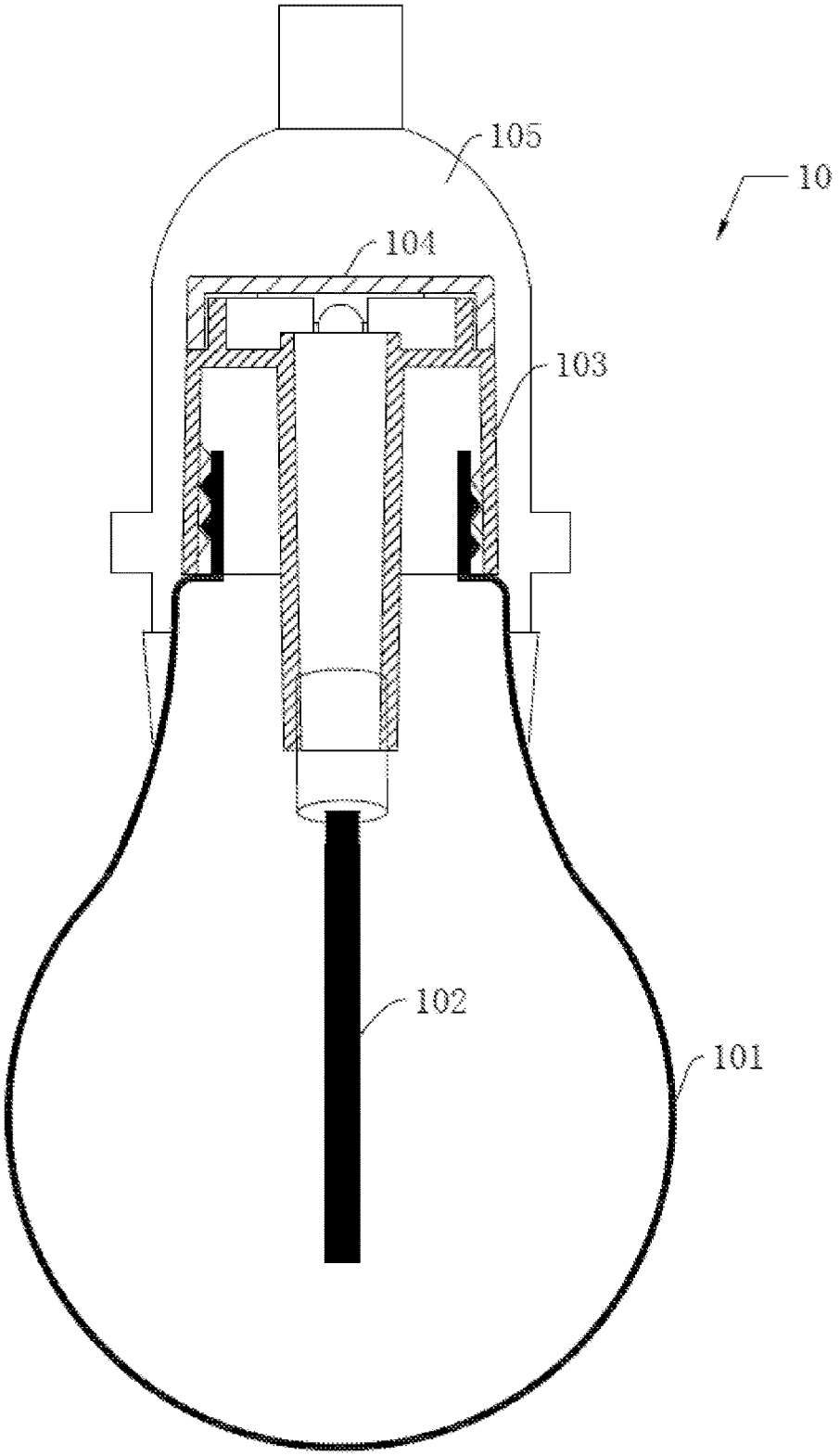
FIG. 1 shows a sectional structural schematic view of a lighting device provided in the present application.

Reference signs: 1—lamp string; 10—lighting device; 101—lamp housing; 102—lighting body; 1021, 201—male connector; 103—lamp base; 1031, 202—female connector; 1032—installation hole; 104—lamp cover; 105—lampshade; 106—bracket; 20—lamp wire.

DETAILED DESCRIPTION OF EMBODIMENTS

Below, various examples of the present application will be described more comprehensively in combination with the accompanying drawings. The present application can have various examples, and modifications and alterations can be made thereto. Therefore, the present application will be described with more details with reference to specific examples shown in the accompanying drawings. However, it should be understood that the various examples of the present application are not intended to be limited to the specific examples of the present application, while the present application should be construed as covering all modifications, equivalents, and/or optional solutions falling into the spirit and scope of various examples of the present application. In combination with the description of the accompanying drawings, the same reference signs refer to the same elements.

Below, the term "include" or "can include" which can be used in various examples of the present application indicates the presence of a function, operation or element claimed, and does not limit the increasing of one or more functions, operations or elements. Besides, terms such as "include", "have" and paronyms thereof as used in various examples of the present application are merely intended to indicate specific features, numbers, steps, operations, elements, components or combinations of the foregoing, and should not be construed as initially excluding the possibility of the presence of one or more other features, numbers, steps, operations, elements, components or combinations of the foregoing or increasing of one or more other features, numbers, steps, operations, elements, components or combinations of the foregoing.

In various examples of the present application, the expression "or" or "at least one from A or/and B" includes any combination or all combinations of the literally listed simultaneously. For example, the expression "A or B" or "at least one from A or/and B" can include A, can include B or can include both A and B.

The expressions (such as "first" and "second") used in various examples of the present application can modify various constituent elements in the various examples, but may not limit the corresponding constituent elements. For example, the above expression does not limit the order and/or importance of the elements. The above expressions are merely intended to distinguish one element from other elements. For example, a first user device and a second user device refer to different user devices, although both are user devices. For example, a first element may be called as a second element, likewise, a second element also can be called as a first element, without departing from the scope of the various examples of the present application.

It should be noted that if one constituent element is described as being "connected" to another constituent element, the first constituent element can be directly connected to the second constituent element, and a third constituent element can be "connected" between the first constituent element and the second constituent element. On the contrary, when one constituent element is "directly connected" to another constituent element, it can be construed as no third constituent element is present between the first constituent element and the second constituent element.

The terms used in various examples of the present application are merely used to describe specific examples, rather than limiting the various examples of the present application. As used herein, a singular form also includes plural form, unless otherwise clearly indicated in the context. Unless otherwise defined, all terms (including technical terms and scientific terms) used herein have the same meaning as that generally understood by a person ordinarily skilled in the art of the various examples of the present application. The terms (such as the terms defined in dictionaries commonly used) shall be construed as having the same meaning as that in the context of relevant technical field and shall not be construed as having an ideal meaning or too formal meaning, unless clearly defined in various examples of the present application.

Below, embodiments of the present application will be described in detail in combination with the accompanying drawings.

Example 1

Figure 2:
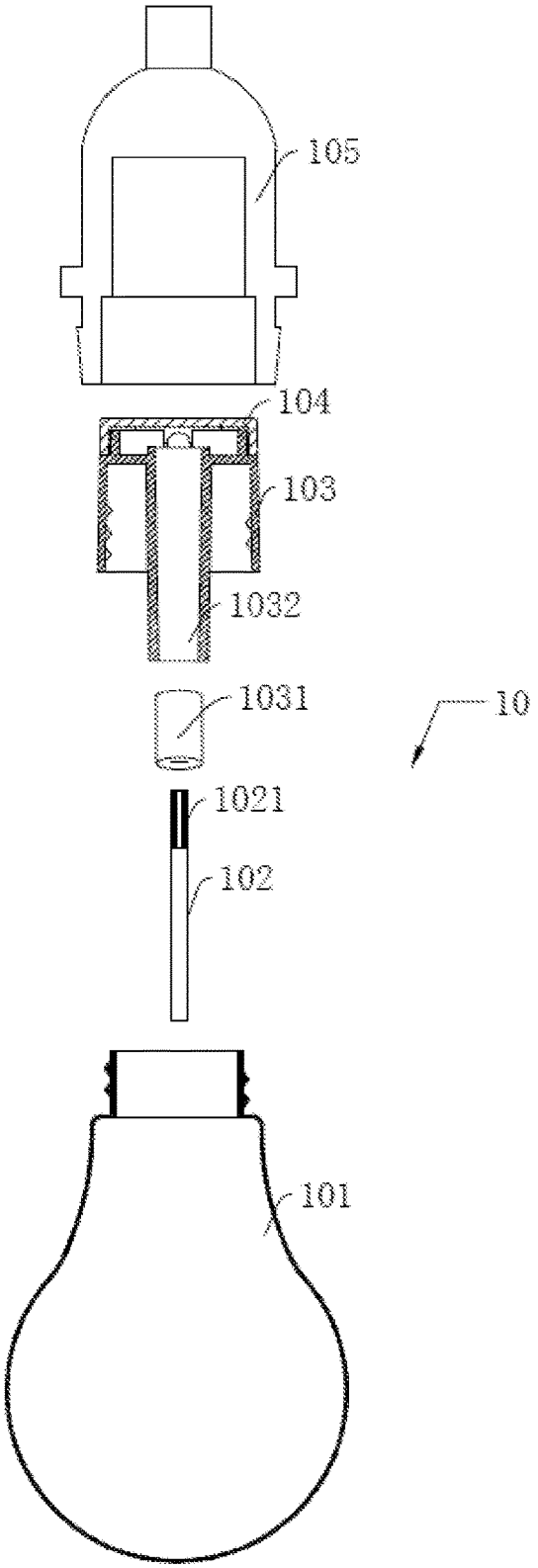
FIG. 2 shows an exploded structural schematic view of the lighting device of FIG. 1.

FIG. 1 shows a sectional structural schematic view of a lighting device 10, and FIG. 2 shows an exploded structural schematic view of the lighting device 10.

The lighting device 10 includes a lamp housing 101, a lighting body 102 and a lamp base 103. The lamp base 103 is detachably connected with the lamp housing 101, and the lamp base 103 is in detachable electrical connection with the lighting body 102.

The lighting device 10 in the present application can be applied to the field of decorative lamps. The lighting body 102 is embodied as a lighting element. The lamp base 103 supplies power to the lighting body 102. The lamp housing 101, upon connected with the lamp base 103, encapsulates the lighting body 102 therein, to protect the lighting body 102 and allows the light emitted by the lighting body 102 to be transmitted out therefrom. Through the detachable connection between the lamp base 103 and the lamp housing 101, and the detachable connection between the lighting body 102 and the lamp base 103, a power supply line of the lighting body 102 directly comes out from the lamp base 103, and the lighting body 102 and the lamp housing 101 are directly connected to the lamp base 103, omitting a lamp holder. Moreover, according to its detachable property, when the lighting body 102 is damaged, the lighting body 102 can be replaced separately, rather than replacing the whole lighting device 10, greatly reducing the production, maintenance and using costs.

The working voltage of the lighting body 102 is direct-current 3V-36V. The lighting device 10 is a type of electrical element working under direct current and low voltage, which is safe to use and has a small power and a small heating amount, without the need of considering the heat dissipation problem of the lighting device 10.

Meanwhile, the lamp holder of the lighting device 10 is not provided with an adapter (the adapter serves the function of converting a high-voltage alternating current to a direct current), leading to a simpler internal structure, and it only needs to electrically connect the lighting body 102 onto the lamp holder. The whole lighting device 10 is more lightweight, and the heating amount is further decreased. At the same time, the manufacturing cost of the lighting device 10 is further reduced since no adapter is provided inside the lighting device 10. The adapter can be connected from outside, and especially when a plurality of lighting devices 10 are used together, the problem of power supply may be solved by only additionally providing one adapter.

The lamp housing 101 is a plastic lamp housing 101, and the lamp base 103 is a plastic lamp base 103. The plastic can be selected from, but not limited to the following several types of plastics: polyethylene (PE), polypropylene (PP), polyvinyl chloride (PVC), acrylonitrile-butadiene-styrene copolymer (ABS), polymethacrylate (ACRYLIC PMMA), polycarbonates (PC), and polystyrene (PS).

The plastic lamp base 103 and the plastic lamp housing 101 have relatively high plasticity, chemical stability, and weatherability, and are easy to color, and the lamp housing 101 and the lamp base 103 of different colors can be used according to practical using requirements, meanwhile, due to the property of plastics, the lamp housing 101 and the lamp base 103 have a light weight and high strength, and in transportation or usage, they will not be easily damaged when crashed. The lamp housing 101 should have light permeability so as to guide light emitted by the lighting body 102 outwardly, while the lamp base 103 is not required to transmit light, and the lamp base 103 can be made from an opaque plastic, so that light of the lighting body 102 is intensively transmitted from the lamp housing 101.

Meanwhile, when the lamp base 103 and the lamp housing 101 are both made from plastics, when heated or cooled, the expansion and contraction degrees are relatively synchronized, and the component with relatively poor strength will not be damaged when connected due to different hardness/strength and the like. In the present example, the lamp housing 101 is blow-molded using a transparent plastic with high light transmission (such as ACRYLIC and PC), and the lamp base 103 is injection-molded from an opaque plastic (such as PC). The blow-molded lamp housing 101 has a uniform wall thickness and a relatively complete structure, meanwhile, it has relatively good mechanical property and better optic isotrope since light transmitted from the lamp housing 101 is more uniform. The injection-molded lamp base 103 has better structural integrity and better mechanical property, has no concentration of stress, and is solid and durable.

The lamp base 103 is detachably connected with the lamp housing 101, for example, by threaded connection.

The threaded connection has relatively good detachable property, meanwhile, the threaded connection is reliable and achieves relatively good sealing effect, thus effectively preventing impurities such as dust, liquid and the like from entering the lighting device 10. In order to further enhance the dustproofness and waterproofness between the lamp housing 101 and the lamp base 103, a waterproof sealing ring may be additionally provided at a place of threaded connection.

In the present example, the lamp housing 101 is provided with outer threads, the lamp base 103 is provided with inner threads, and the connection is realized by screwing the lamp housing 101 on the lamp base 103. In order to achieve relatively good connection sealability between the lamp base 103 and the lamp housing 101, a sealing ring is provided at a junction of the outer thread of the lamp housing 101 with the lamp housing 101, and when the lamp housing 101 is screwed on the lamp base 103, the sealing ring is tightly pressed and deformed, thereby generating an elastic restoring force, so as to fill up a gap between the lamp base 103 and the lamp shell 101 and expand to be clamped tightly within the gap, thus achieving the sealing function, preventing the impurities such as dust, liquid, etc. from entering the lighting device 10, and prolonging the service lifetime of the lighting device 10.

The lighting body 102 is electrically connected with the lamp base 103 through a female connector and a male connector.

The electrical connection realized by the female and male connectors is electrical connection formed by connection between the male connector 1021 and the female connector 1031, and an electrical signal of the electrical connection is stable, with stable connection and convenient installation and disassembling.

In the present example, the lighting body 102 is provided with the male connector 1021, the male connector 1021 being formed by a positive terminal and a negative terminal of the lighting body 102, and the lamp base 103 is provided with the female connector 1031. The connecting manner of the female and male connectors is just the connecting manner of a plug and a socket, that is, the lighting body 102 is provided with a plug, and the lamp base 103 is provided with a jack. In the present example, the female connector 1031 is provided with electrical spring sheets, by which the male connector 1021 inserted into the female connector 1031 is held tightly, so that the connection of the lighting body 102 with the female connector 1031 is more reliable, and is not easy to loosen, avoiding poor power supply contact of the lighting body 102 caused by bad connection between the lighting body 102 and the female connector 1031.

It should be indicated that that the female connector 1031 on the lamp base 103 is the female connector 1031 inserted into the lamp base 103. The lamp base 103 is provided with an installation hole 1032, and the female connector 1031 is inserted into the installation hole 1032 so as to be fixed on the lamp base 103. The female connector 1031 has a base body made from an insulated elastic material. The base body of the female connector 1031 is in a cylindrical shape. The lamp base 103 is provided with a circular hole. The female connector 1031 is fixed in the lamp base 103 through interference fit between the female connector 1031 and the circular hole.

In another example, the lighting body 102 is provided with the female connector 1031, the female connector 1031 being formed by a positive terminal and a negative terminal of the lighting body 102, and the lamp base 103 is provided with the male connector 1021.

In the present example, the lighting body 102 is an LED lamp filament, in which a flexible circuit is provided, so that the positive terminal and the negative terminal of the LED filament extend out from one side of the LED filament, and the LED filament is inserted into the female connector 1031.

The LED filament is in a column shape, in which a bent circuit is provided, so that the positive terminal and the negative terminal extend out directly from one side of the LED filament, and the positive terminal and the negative terminal directly form the male connector 1021. Thus, the LED filament can be directly inserted into the female connector 1031, achieving more convenient installation and disassembling and a simpler structure. The LED filament is a type of stereoscopic light source emitting light in a range of 360°, so that the power factor of the power supply is maximized, the cost is minimized, a brand-new light vision can be achieved, and an original lighting environment of "incandescent lamp" is able to be experienced.

In the present example, the installation hole 1032 is a through hole running through the lamp base 103. Providing the installation hole 1032 as the through hole, on one hand, facilitates the disassembling (pushing out from one end of the installation hole 1032 to the other end) of the female connector 1031 interference-fit in the installation hole 1032, and on the other hand, facilitates wiring, where the electrical wire, after electrical connection with the female connector 1031, runs outwardly from the installation hole 1032.

The lighting device 10 further includes a lamp cover 104, and the lamp cover 104 is provided to be covered at an end of the lamp base 103 for blocking the installation hole 1032. Additionally providing the lamp cover 104 enhances the waterproofness of the lighting device 10, efficiently prevents water, dusts, and the like from entering the female connector 1031 from the installation hole 1032 to damage the female connector 1031, and especially overcomes the problem of short circuit of the circuit of the lighting device 10 easily caused by water inflow. The lamp cover 104 may be clamped over the lamp base 103.

The lamp cover 104 or the lamp base 103 is provided with a threading hole communicating with the installation hole 1032. The electrical wire electrically connected with the female connector 1031 needs an external power supply to realize power supply to the lighting body 102, therefore, the threading hole needs to be additionally provided on the lamp cover 104 or the lamp base 103, so that the electrical wire in the installation hole 1032 runs out from the threading hole.

The lighting device 10 further includes a lampshade 105, the lampshade 105 is covered over the lamp base 103, with the lamp base 103 entirely covered by the lampshade 105. The lamp cover 105 can be clamped outside the lamp base 103. A threading hole is provided at a top end of the lampshade 105, and communicates with the threading hole of the lamp base 103, so that the electrical wire running out from the lamp base 103 comes out again from the lampshade 105, to achieve the object of wiring with the outside. Meanwhile, additionally providing the lampshade 105 can further enhance the dustproof and waterproof performances of the lighting device 10, improve the integrity of the appearance of the lighting device 10, and accommodate the electrical wire in the lampshade 105.

Example 2

Figure 3:
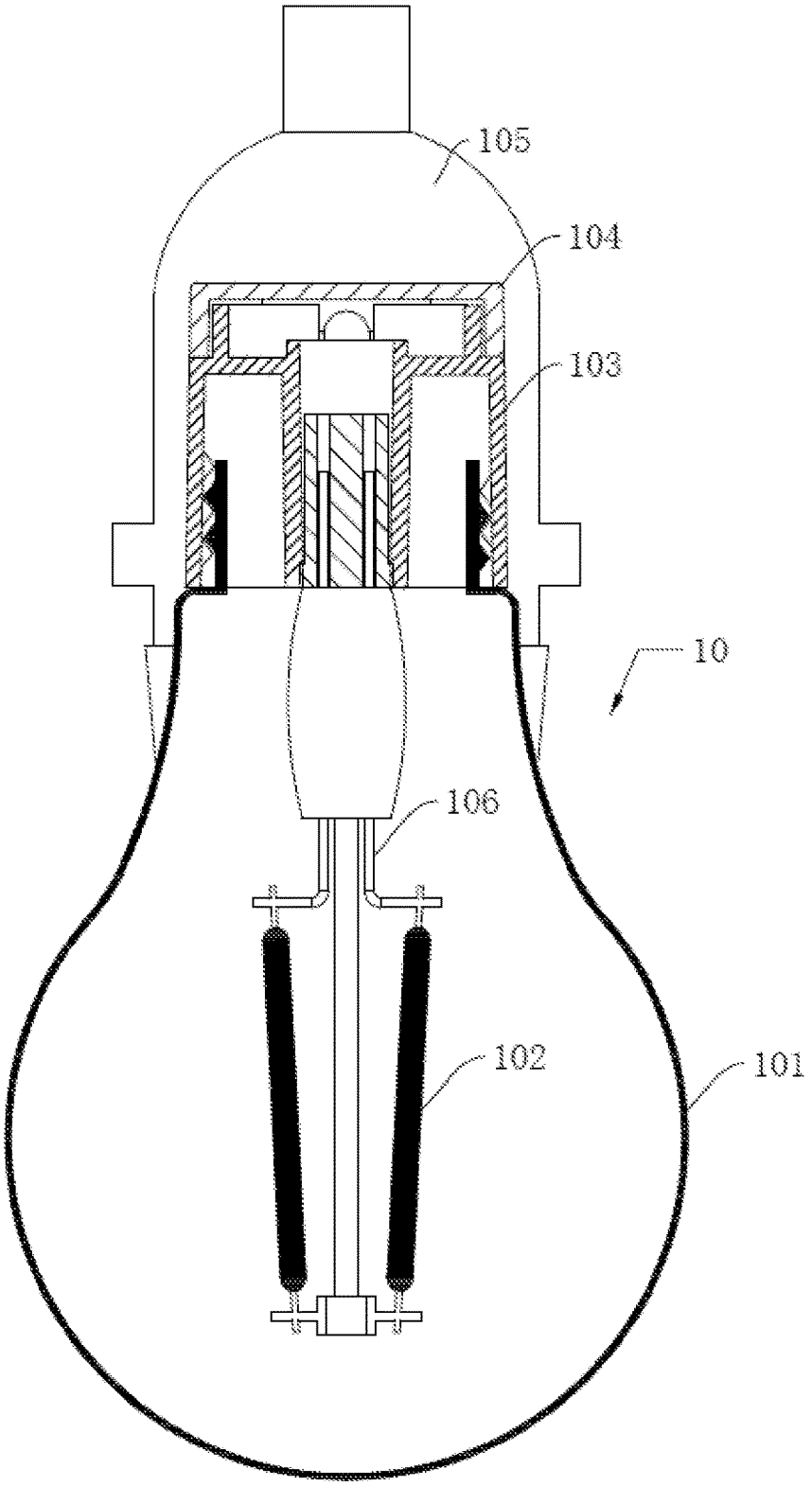
FIG. 3 shows a sectional structural schematic view of another lighting device provided in the present application.
Figure 4:
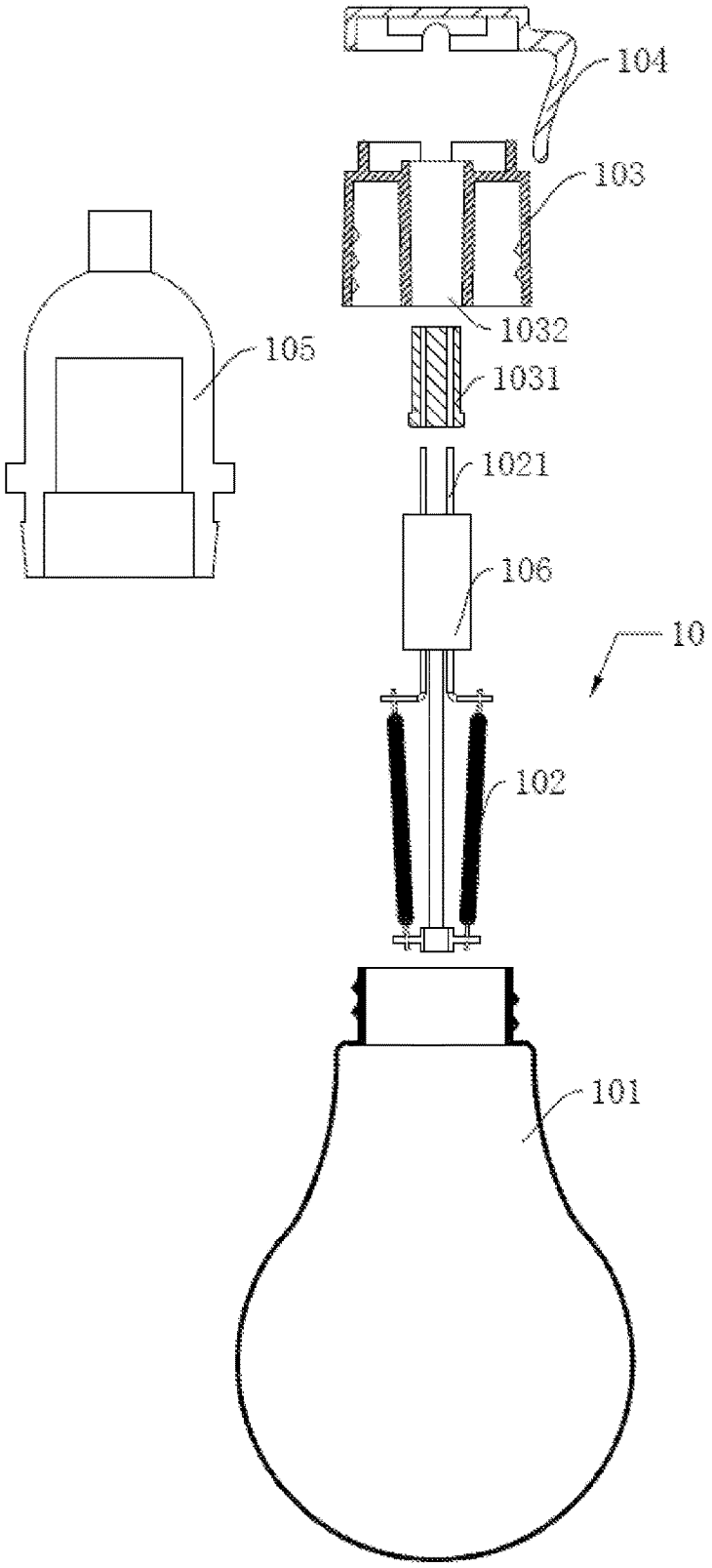
FIG. 4 shows an exploded structural schematic view of the lighting device of FIG. 3.

FIG. 3 shows a sectional structural schematic view of a lighting device 10, and FIG. 4 shows an exploded structural schematic view of the lighting device 10.

The present example is distinguished from Example 1 in that the lighting device 10 in the present example further includes a bracket 106, the lighting body 102 is embodied as an LED filament, the LED filament is in a column shape, a positive electrode and a negative electrode stretch out from two ends of the LED filament, the LED filament is electrically connected onto the bracket 106, a male connector 1021 is provided on the bracket 106, i.e. the positive electrode and the negative electrode of the LED filament are electrically connected with a positive electrode and a negative electrode of the male connector 1021 respectively.

The bracket 106 is used to support the lighting body 102 as a carrier of the lighting body 102, so that electrical connection is formed between the lighting body 102 and the lamp base 103. Through the detachable electrical connection between the bracket 106 and the lamp base 103, detachable electrical connection is formed between the lighting body 102 and the lamp base 103.

Different from the conventional glass brackets, the present bracket 106 is a ACRYLIC bracket 106.

ACRYLIC, a type of organic glass, has relatively high plasticity, and it overcomes the defects of high fragility and vulnerability of the conventional glass, and it will not produce sharp fragments even when damaged, so it is safer to use. Meanwhile, ACRYLIC has crystalline transparency, with a light transmittance of above 92%, which reduces the lighting loss of the lighting body 102. The ACRYLIC bracket 106 has extremely good weatherability, relatively high surface hardness and surface gloss, and relatively good high-temperature performance, meanwhile it still has good processing performance, so as to be thermally formed, and also can be mechanically machined. In the present example, the ACRYLIC bracket 106 is molded in a thermal-forming manner.

In another example, the bracket 106 is made from a transparent PC material. The PC material has relatively low fragility, so that the bracket 106 has better durability.

In the present example, two lighting bodies 102 are welded on the bracket 106 and distributed in a trapezoid shape. In other examples, one, three, or more lighting bodies 102 can be welded on the bracket 106, and they can be distributed side by side or circumferentially. The shape of the LED filament is not limited to the cylindrical shape, but still can be of other shapes, such as M shape, H shape or other special shapes.

The bracket 106 is electrically connected with the lamp base 103 through the female and male connectors. In the present example, the bracket 106 is provided with the male connector 1021, the male connector 1021 is electrically connected with the lighting body 102 on the bracket 106, and the lamp base 103 is provided with the female connector 1031. The connecting manner of the female and male connectors is just the connecting manner of a plug and a socket, that is, the bracket 106 is provided with the plug, the lamp base 103 is provided with the jack, in which electrical spring sheets are provided, the plug inserted into the jack is held tightly by the spring sheets, so that the connection of the bracket 106 with the lamp base 103 is more reliable, and is not easy to loosen, avoiding poor power supply contact of the lighting body 102 caused by bad connection between the bracket 106 and the lamp base.

It should be indicated that that the female connector 1031 on the lamp base 103 is the female connector 1031 inserted into the lamp base 103. The lamp base 103 is provided with the installation hole 1032, and the female connector 1031 is inserted into the installation hole 1032 so as to be fixed on the lamp base 103. The female connector 1031 has a base body made from an insulated elastic material. The base body of the female connector 1031 is in a cylindrical shape. The lamp base 103 is provided with a circular hole. The female connector 1031 is fixed in the lamp base 103 through interference fit between the female connector 1031 and the circular hole.

In another example, the bracket 106 is provided with the female connector 1031, with the female connector 1031 electrically connected with the lighting body 102 on the bracket 106, and the lamp base 103 is provided with the male connector 1021.

Example 3

Figure 5:
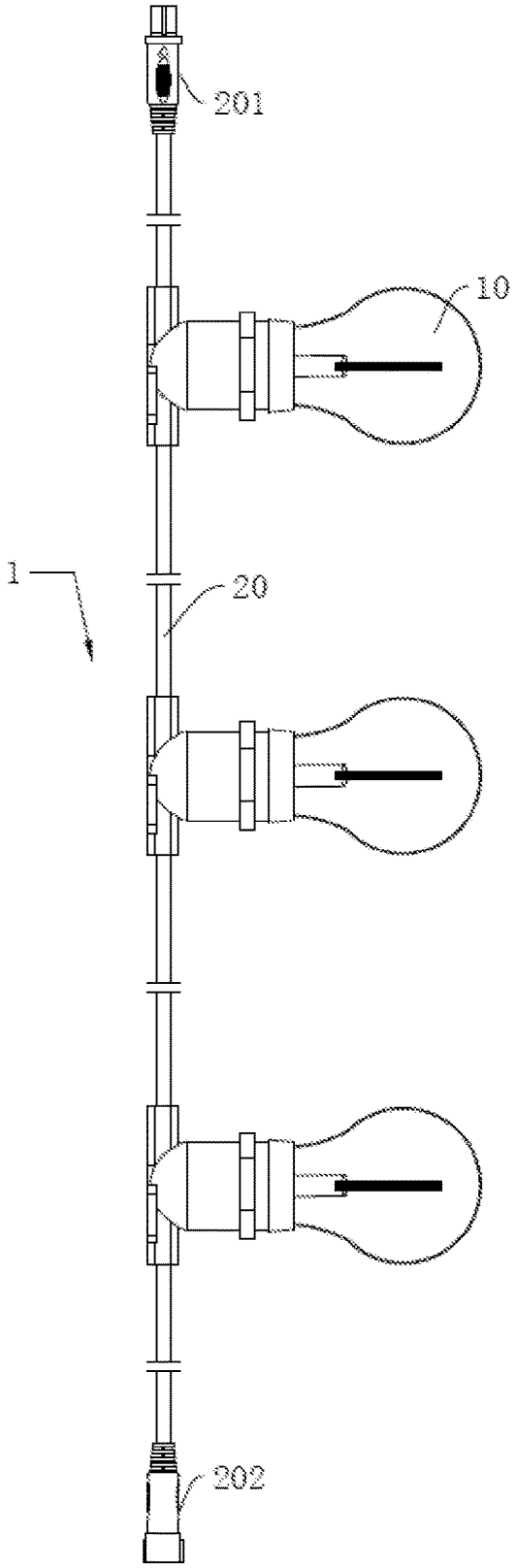
FIG. 5 shows a structural schematic view of a lamp string provided in the present application.

As shown in FIG. 5, the present example provides a lamp string 1, including the lighting device 10 in Example 1 and a lamp wire 20, several lighting devices 10 are electrically connected on the lamp wire 20, and an electrical wire coming out from the lamp base 103 of the lighting device 10 is connected onto the lamp wire 20, thus forming the lamp string 1.

The lamp wire 20 of the lamp string 1 of the present application is directly electrically connected with the electrical wire coming out from the lamp base 103 of the lighting device 10, without the need of using an adapter on an individual lighting device 10, while the whole lamp string 1 only needs to use one adapter, leading to a lower cost.

With reference to FIG. 5, the lamp wire 20 of the lamp string 1 of the present example has one end provided with a male connector 210, and the other end provided with a female connector 202 matched with the male connector 201. Through the male connector 201 and the female connector 202 on the two ends of the lamp wire 20, the lamp strings 1 can be connected with each other. By connecting the male connector 201 of one lamp wire 20 to the female connector 202 of another lamp wire 20, two lamp wires 20 are electrically connected. A plurality of lamp strings 1 can be connected in series according to use requirements, which, actually, is connecting a plurality of lighting devices 10 in parallel. If the lamp string 1 is provided with 10 lighting devices 10, it is a 10-lighting-device lamp string 1, and if a lamp string 1 of more than 100 lighting-devices is to be used, a plurality of lamp strings 1 can be connected, and it only needs to supply power to one lamp string 1, reducing the wiring number of a plurality of lamp strings 1, so that the wiring is simpler, and it is applicable to multiple indoor and outdoor circumstances.

Meanwhile, a power supply voltage of DC 3V-36V needs to be transformed by a transformer for supplying power, and by electrically connecting a plurality of lamp strings 1 through the female and male connectors, the number of the transformers used is reduced, the power connection circuit is simpler, and the working voltage is a low voltage, with high safety.

Figure 6:
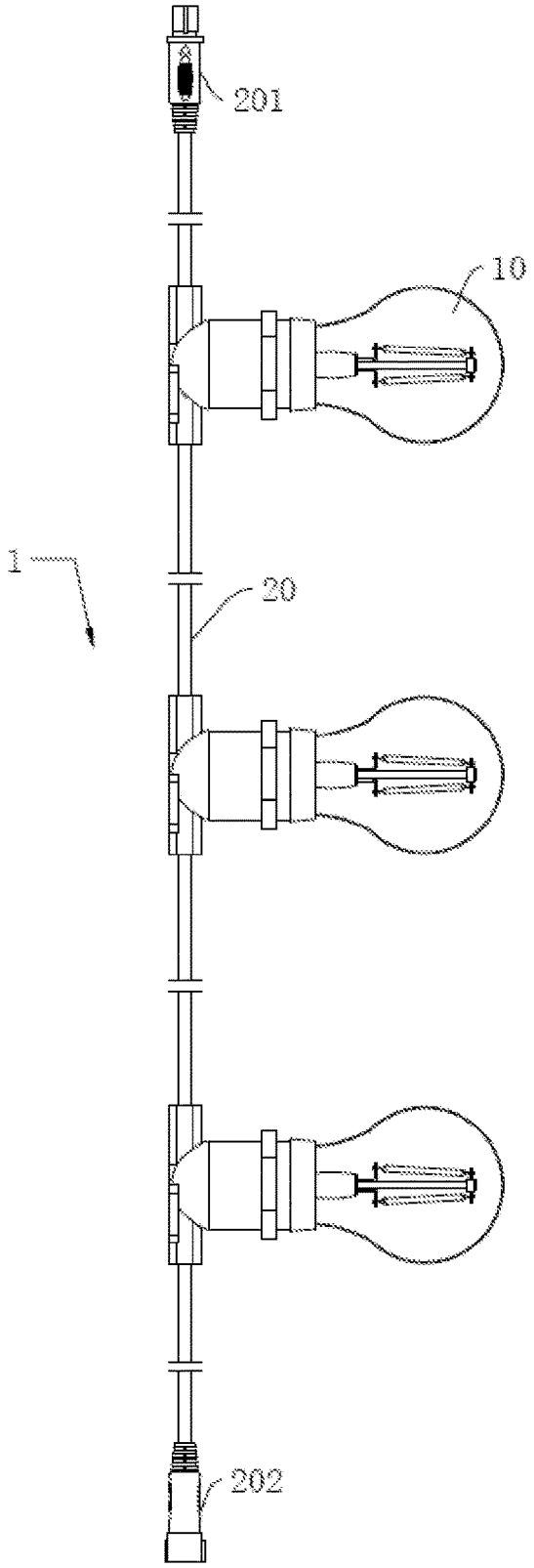
FIG. 6 shows a structural schematic view of another lamp string provided in the present application.

In another example, as shown in FIG. 6, the lamp string 1 includes the lighting device 10 in Example 2.

The lighting device 10 and the lamp string 1 of the present application have the following beneficial effects:

1. The lighting device 10 is powered by direct-current low voltage, with the voltage range of 3V-36V, and is not provided inside with a power supply adapter, which reduces the cost, simplifies the internal structure, decreases the heating amount of the lighting device 10, and improves the use safety of the lighting device 10.

The lamp base 103 and the lamp housing 101 of the lighting device 10 are detachably connected with each other, and the lighting body 102 and the lamp base 103 are detachably connected with each other. The power supply line of the lighting body 102 directly comes out from the lamp base 103, and the lighting body 102 and the lamp housing 101 are directly connected to the lamp base 103, omitting a power supply adapter, reducing the manufacturing cost and the heating amount of the lighting device 10. Moreover, according to its detachability, when the lighting body 102 is damaged, the lighting body 102 can be replaced separately, rather than replacing the whole lighting device 10, with simple operation and use safety, greatly reducing the production, maintenance and using costs 2. By providing the LED filament in the lamp housing 101, a breakthrough is made over the conventional encapsulating technology of tungsten filament bulbs and LED bulbs: firstly welding the filament on a glass conducting support, then fixing the filament between a glass bulb and a metal connecting screw through a calcination process, meanwhile extracting air in the bulb. Meanwhile, in the present lighting device 10, the metal connecting screw of the conventional bulb is omitted, and the glass bulb is replaced with a plastic bulb.

3. Due to the detachable connection between the lamp base 103 and the lamp housing 101, the shape of the lamp housing 101 can be changed at any time, for example, the lamp housing 101 of spheroidal, ellipsoidal, strip, and special shapes, all of these lamp housings 101 can be adapted to the same lamp base 103, so that the lighting device 10 has variable and flexible appearances, moreover, the lamp base 103 and the lamp housing 101 have good interchangeability.

4. By using the LED filament whose positive and negative terminals are at the same end, this LED filament can be directly inserted into the lamp base 103 through the female and male connectors, further simplifying the structure and installation and disassembling.

5. The ACRYLIC bracket 106 is used to replace the conventional glass bracket 106, and the LED filament is connected on the bracket 106 through the bracket 106 so as to be connected to the lamp base 103. ACRYLIC has relatively good machining property and plasticity, and the properties of light weight and high strength, and it will not be easily damaged when crashed, reducing the production, using and maintenance costs as well as transportation and storage costs.

6. The lamp string 1 is formed by connecting a plurality of lighting devices 10 in parallel. The lamp string 1 can be used as a decorative lamp string 1. By means of the male connector 201 and the female connector 202 at the two ends of the lamp wire 20, the lamp string 1 with different numbers of the lighting devices 10 can be formed through series connection according to usage requirements.

In all of the examples shown and described herein, any specific value should be construed as merely being exemplary, rather than limiting, therefore, other examples of the exemplary examples can have different values.

It should be noted that similar reference signs and letters represent similar items in the following figures, therefore, once a certain item is defined in one figure, it is not needed to be further defined or explained in subsequent figures.

The examples mentioned above merely express several embodiments of the present application, and the description thereof is specific and detailed, but cannot be thus construed as limiting the scope of the present application. It should be indicated that a person ordinarily skilled in the art still can make alterations and improvements, without departing from the concept of the present application, all of which fall into the scope of protection of the present application.

The invention claimed is:

1. A lighting device, comprising a lamp housing, a lighting body provided in the lamp housing, and a lamp base connected with the lamp housing, the lamp base being connected with the lighting body, wherein the lamp base is detachably connected with the lamp housing, and the lamp base is in detachable electrical connection with the lighting body through a female connector and a male connector;

and the lighting body has a working voltage of direct-current 3V-36V, and the lamp housing and the lamp base are made from a plastic material, the lamp base is provided thereon with the female connector, the lighting body is embodied as an LED filament, the LED filament is provided thereon with a male connector matched with the female connector, the female connector is provided with electrical spring sheets, by which the male connector inserted into the female connector is held tightly, the lamp base is provided with an installation hole, and the female connector is fixed in the lamp base through interference-fit in the installation hole.

2. The lighting device of claim 1, wherein the installation hole is a through hole running through the lamp base, the lighting device further comprises a lamp cover, and the lamp cover is covered at an end of the lamp base for blocking the installation hole; and the lamp cover or the lamp base is provided with a threading hole communicating with the installation hole.

3. The lighting device of claim 2, wherein the lighting device further comprises a lampshade, and the lampshade is covered over the lamp base.

4. The lighting device of claim 1, wherein a flexible circuit is provided in the LED filament so that a positive terminal and a negative terminal of the LED filament extend out from one side of the LED filament, and the LED filament is inserted into the female connector.

5. The lighting device of claim 1, wherein the lighting device further comprises a bracket, the LED filament is electrically connected onto the bracket, and the bracket is provided thereon with the male connector.

6. The lighting device of claim 1, wherein the lighting device further comprises a lampshade, and the lampshade is covered over the lamp base.

7. The lighting device of claim 1, wherein the lighting device further comprises a lampshade, and the lampshade is covered over the lamp base.

8. The lighting device of claim 1, wherein the lighting device further comprises a lampshade, and the lampshade is covered over the lamp base.

9. The lighting device of claim 1, wherein the lamp housing and the lamp base are connected through threads.

10. A lamp string, comprising a lamp wire, wherein the lamp string further comprises several lighting devices electrically connected onto the lamp wire, wherein the lighting devices each comprises a lamp housing, a lighting body provided in the lamp housing, and a lamp base connected with the lamp housing, the lamp base being connected with the lighting body, wherein the lamp base is detachably connected with the lamp housing, and the lamp base is in detachable electrical connection with the lighting body through a female connector and a male connector; and the lighting body has a working voltage of direct-current 3V-36V, and the lamp housing and the lamp base are made from a plastic material, the lamp base is provided thereon with the female connector, the lighting body is embodied as an LED filament, the LED filament is provided thereon with a male connector matched with the female connector, the female connector is provided with electrical spring sheets, by which the male connector inserted into the female connector is held tightly, the lamp base is provided with an installation hole, and the female connector is fixed in the lamp base through interference-fit in the installation hole.

11. The lamp string of claim 10, wherein the installation hole is a through hole running through the lamp base, the lighting device further comprises a lamp cover, and the lamp cover is covered at an end of the lamp base for blocking the installation hole; and the lamp cover or the lamp base is provided with a threading hole communicating with the installation hole.

12. The lamp string of claim 10, wherein a flexible circuit is provided in the LED filament so that a positive terminal and a negative terminal of the LED filament extend out from one side of the LED filament, and the LED filament is inserted into the female connector.

13. The lamp string of claim 10, wherein the lighting device further comprises a bracket, the LED filament is electrically connected onto the bracket, and the bracket is provided thereon with the male connector.

14. The lamp string of claim 10, wherein the lighting device further comprises a lampshade, and the lampshade is covered over the lamp base.

15. The lamp string of claim 10, wherein the lamp housing and the lamp base are connected through threads.

16. The lamp string of claim 10, wherein two ends of the lamp wire are respectively provided with a male connector and a female connector which are matched with each other.

* * * * *